US009666946B1

(12) United States Patent
Sharawi et al.

(10) Patent No.: US 9,666,946 B1
(45) Date of Patent: May 30, 2017

(54) FOUR ELEMENT RECONFIGURABLE MIMO ANTENNA SYSTEM

(71) Applicant: KING FAHD UNIVERSITY OF PETROLEUM AND MINERALS, Dhahran (SA)

(72) Inventors: Mohammad S. Sharawi, Dhahran (SA); Rifaqat Hussain, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 13 days.

(21) Appl. No.: 14/940,118

(22) Filed: Nov. 12, 2015

(51) Int. Cl.

| | |
|---|---|
| ***H01Q 1/48*** | (2006.01) |
| ***H01Q 9/04*** | (2006.01) |
| ***H01Q 1/12*** | (2006.01) |
| ***H01Q 21/06*** | (2006.01) |
| ***H01Q 5/321*** | (2015.01) |

(52) U.S. Cl.
CPC ..... *H01Q 9/0442* (2013.01); *H01Q 1/12* (2013.01); *H01Q 1/48* (2013.01); *H01Q 5/321* (2015.01); *H01Q 21/065* (2013.01)

(58) Field of Classification Search
CPC ..... H01Q 1/12; H01Q 1/48; H01Q 5/321
USPC ..... 343/750
See application file for complete search history.

(56) References Cited

U.S. PATENT DOCUMENTS

| | | | |
|---|---|---|---|
| 7,525,504 | B1 | 4/2009 | Song et al. |
| 7,701,395 | B2 | 4/2010 | Alvey et al. |
| 8,502,739 | B2 | 8/2013 | Ollikainen et al. |
| 8,744,373 | B2 | 6/2014 | Pourseyed |
| 8,786,497 | B2 | 7/2014 | Sharawi |
| 2015/0102969 | A1 | 4/2015 | Song et al. |
| 2015/0180514 | A1 | 6/2015 | Pavacic et al. |

OTHER PUBLICATIONS

Al-Alaa et al., "Compact multi-band frequency reconfigurable planar monopole antenna for several wireless communication applications," *Journal of Electrical Systems and Information Technology*, vol. 1, Issue 1, pp. 17-25, Available on-line Mar. 24, 2014.

Lee et al., "Frequency Reconfigurable Planar Inverted-F Antenna (PIFA) for Cell-Phone Applications," Progress in Electromagnetics Research C, vol. 32, pp. 27-41, 2012.

Sharawi et al., "Planar Four-Element Frequency Agile MIMO Antenna System with Chassis Mode Reconfigurability," Microwave and Optical Technology Letters, Aug. 2015, published on the Internet Jun. 20, 2015.

*Primary Examiner* — Graham Smith
*Assistant Examiner* — Andrea Lindgren Baltzell
(74) *Attorney, Agent, or Firm* — Richard C. Litman

(57) ABSTRACT

The four element reconfigurable MIMO antenna system includes four conducting PIFA elements disposed on a top surface of a rectangular dielectric substrate. For each PIFA, an F-head portion of the PIFA defines two arms extending to a long peripheral edge of the substrate. An F-tail portion of the PIFA extends from a short peripheral edge of the substrate. A first PIFA and a second PIFA are mirror images of each other, and a third PIFA and a fourth PIFA are mirror images of each other. A meander pattern of conducting material extends from a bottom region of the F-tail portion of the PIFAs. For each PIFA, PIN/varactor diode bias circuits are disposed on the substrate's top surface, connecting to and extending away from a unique location on the F-tail portion of the PIFA, thereby creating separate radiating branches of the PIFA to achieve reconfigurability.

12 Claims, 13 Drawing Sheets

FOUR ELEMENT RECONFIGURABLE MIMO ANTENNA SYSTEM

BACKGROUND OF THE INVENTION

1. Field of the Invention

The present invention relates to multi-band wireless communication systems, and particularly to a four element reconfigurable MIMO antenna system for a cognitive radio platform for compact wireless devices and LTE mobile handsets.

2. Description of the Related Art

In modern wireless communications, the exponential growth of wireless services results in an increasing demand of the data rate requirements and reliability of data. These services may include high-quality audio/video calls, online video streaming, video conferencing and online gaming. These demanding features may require wide bandwidth to cover operation across several frequency bands. This provides motivation towards the comprehensive and efficient utilization of the available spectrum. The desire to overcome inefficient and highly underutilized spectrum resources has led to the concept of cognitive radio (CR). A CR system is based on structural design of a software-defined radio intended to enhance spectrum utilization efficiency by interacting with the operating environment. A CR-based system must be aware of its environment by sensing spectrum usage and have the capability to switch over the operating points among different unoccupied frequency bands. A CR-based system may have various features, including sensing the spectrum of nearby devices, switching between different frequency bands, and power level adjustment of transmitting antennas.

Reconfigurable antennas are able to change their operating fundamental characteristics, e.g., resonant frequency, radiation pattern, polarization, and impedance bandwidth. A frequency reconfigurable antenna is an essential component of CR platforms. An attractive feature of such an antenna is the ability to switch across several frequency bands by activating different radiating parts of the same antenna. CR-based systems are capable of switching the frequency bands of a single frequency reconfigurable antenna over different bands to efficiently and inclusively utilize the idle spectrum.

To achieve the desired characteristics of reconfigurability and the desired performance of a MIMO antenna system, several challenges need to be overcome. These issues include the size of the antennas for low frequency bands, the high isolation required between closely spaced antennas, and control circuitry embedded within the given antenna size to achieve the desired reconfiguration. The performance of a MIMO system degrades significantly for closely spaced antennas due to high mutual coupling.

Thus, a four element reconfigurable MIMO antenna system solving the aforementioned problems is desired.

SUMMARY OF THE INVENTION

The four element reconfigurable MIMO antenna system includes operability over several frequency bands. Two versions of the present design, D1 and D2, are presented. The D1 design is a 4-element reconfigurable MIMO antenna system with enhanced isolation, while the D2 design is a 4-element reconfigurable MIMO having a chassis-mode reconfigurability option. The complete setup is suitable for a CR platform for 4G wireless standards. Both antenna designs are frequency reconfigurable MIMO antenna systems. Both designs are planar in structure and can be easily integrated with microwave or digital IC's and other low profile microwave components. Thus, they can be easily accommodated within wireless handheld devices. The frequency of interest is the wireless band between 700 MHz and 3 GHz. Additionally, the present system provides a planar structure with operation across several lower frequency bands, starting from 0.7 GHz up to 3 GHz.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1B:
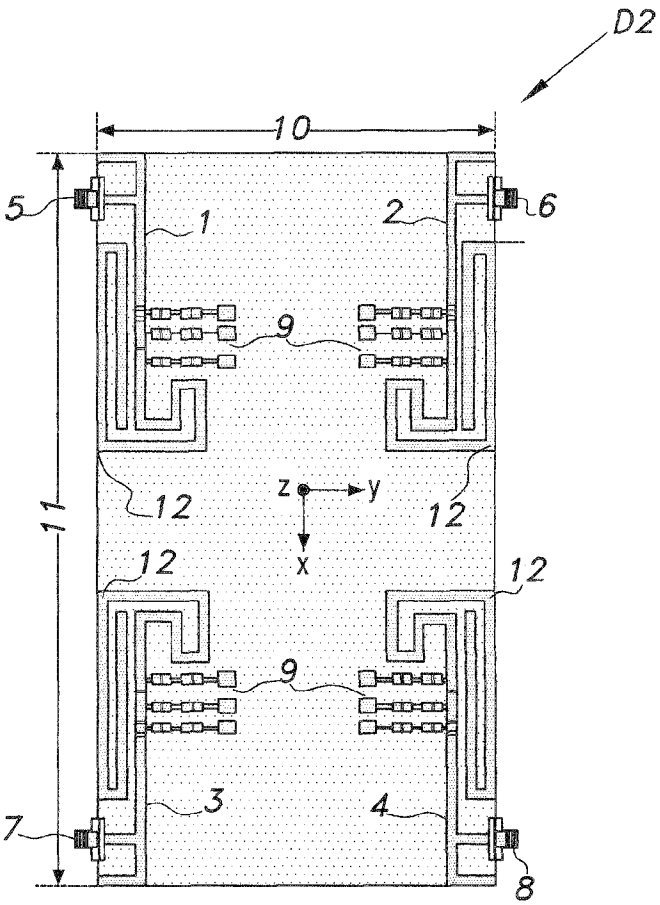
FIG. 1B is a top view of a printed circuit board of a second embodiment of a four element reconfigurable MIMO antenna system according to the present invention, showing the four radiating elements.
Figure 1A:
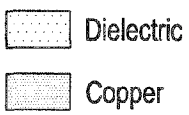
FIG. 1A is a top view of a printed circuit board of a first embodiment of a four element reconfigurable MIMO antenna system according to the present invention, showing the four radiating elements.
Figure 1A:
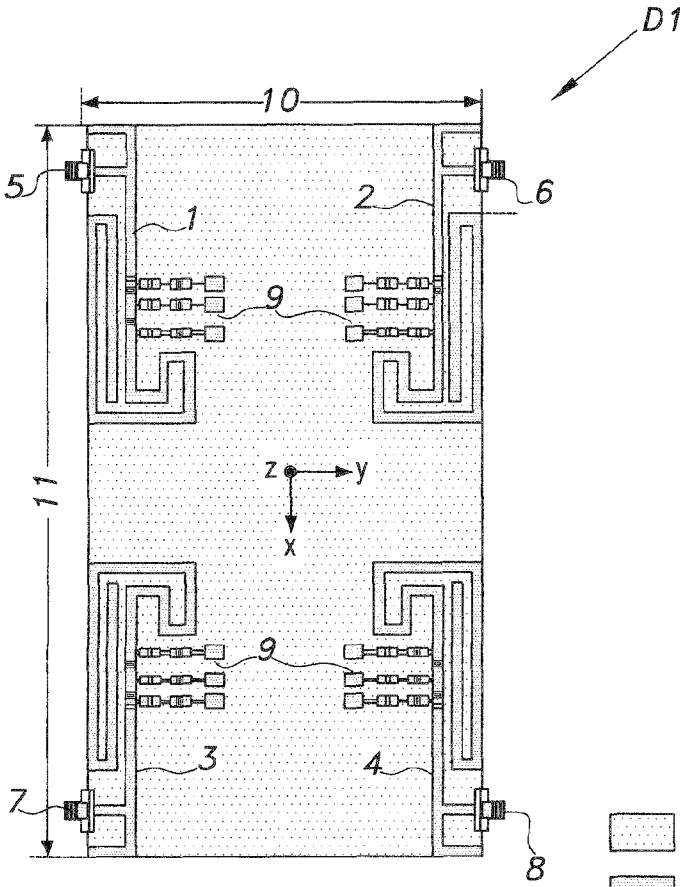

The top surface of printed circuit boards for a first and a second embodiment of the four element reconfigurable MIMO antenna system are shown in FIGS. 1A and 1B. ANSYS® Professional software high frequency structural simulator (HFSS™) is used to observe the reflection response and the radiation properties of the antenna. An ANSYS® HFSS™ model of the frequency reconfigurable 4-element MIMO antenna system is built for verification of the antennas shown in FIG. 1A and FIG. 1B. FIG. 1A shows the top surface of the board of antenna D1. FIG. 1B shows the top surface of the board of antenna D2. It will be noted that the top surface of the board is substantially identical in each of the two embodiments. Each antenna system (D1 and D2) contains four patch antennas of a Planar Inverted-F Antenna (PIFA) design. The Planar Inverted-F antenna (PIFA) is common in cellular phones (mobile phones) with built-in antennas. The PIFA MIMO antennas of the present system are shown as reconfigurable antennas 1, 2, 3, 4, respectively. The four conducting (exemplary copper) PIFA elements 1, 2, 3, and 4 are disposed on a top surface of the rectangular dielectric substrate shown. For each PIFA, an F-head portion of the PIFA is formed by two arms extending to a long peripheral edge (the edge having dimension 11) of the rectangular dielectric substrate. The F-tail portion of the PIFA extends from a short peripheral edge (the edge having dimension 10) of the rectangular dielectric substrate. The first PIFA 1 and the second PIFA 2 are mirror images of each other. The third PIFA 3 and the fourth PIFA 4 are mirror images of each other. A meander pattern of conducting (copper) material extends from a bottom region of the F-tail portion of the PIFAs. The given antenna elements 1, 2, 3, and 4 are fed by SubMiniature version A (SMA) RF coaxial connectors (5, 6, 7, 8), respectively. For each PIFA, the SMA feed connector is connected to the F-head portion arm that is most distal from the short peripheral edge (the edge having dimension 10). The reconfigurable MIMO antennas 1, 2, 3, and 4 are fabricated on the dielectric substrate, which has a height less than 1.6 mm.

Figure 2B:
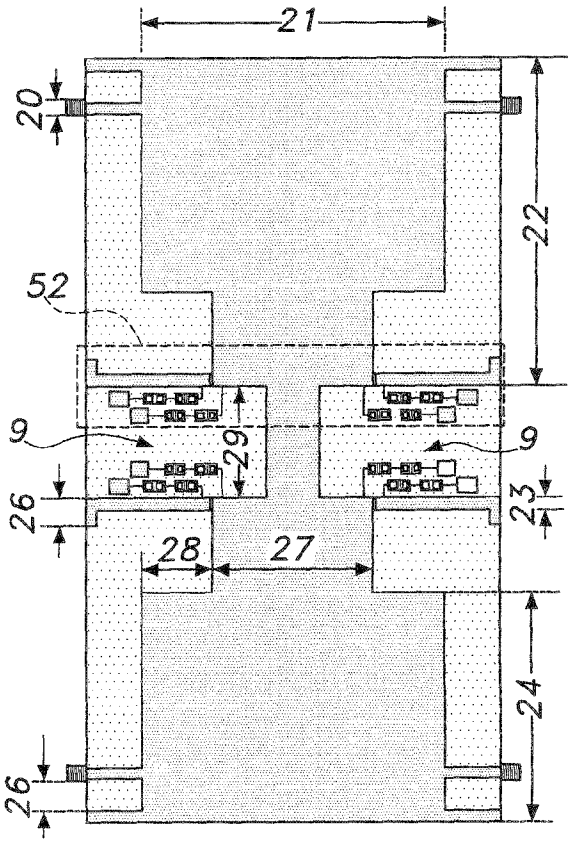
FIG. 2B is a bottom view of the printed circuit board of the antenna system of FIG. 1B, showing the ground plane configuration.
Figure 2A:
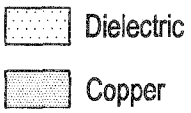
FIG. 2A is a bottom view of the printed circuit board of the antenna system of FIG. 1A, showing the ground plane configuration.
Figure 2A:
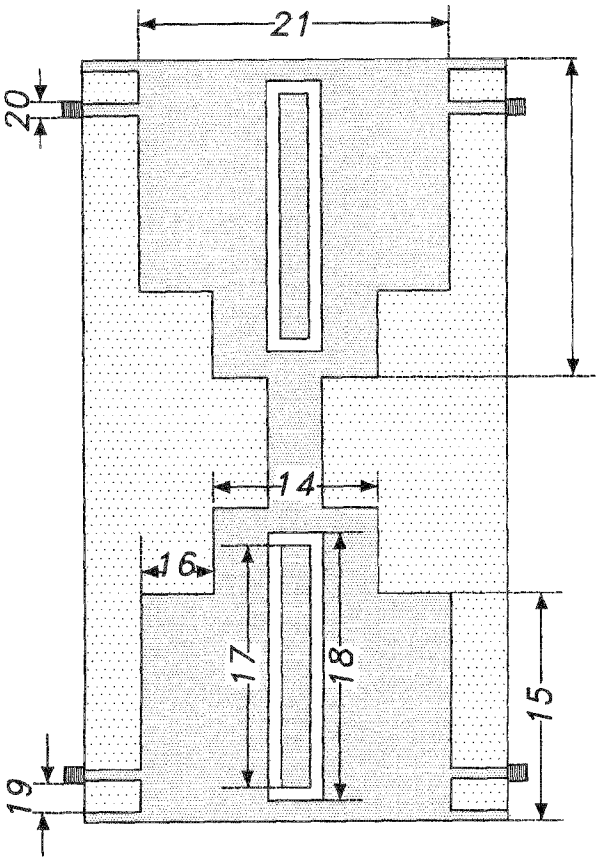

A PIN diode is a diode with a wide, undoped intrinsic (I) semiconductor region between a P-type semiconductor and an N-type semiconductor region. For each PIFA, three diode circuits are used. Each diode circuit is disposed on the dielectric substrate's top surface, connecting to and extending away from a unique location on the F-tail portion of the PIFA, thereby creating separate radiating branches of the PIFA. For each design, D1, D2, reconfigurability is achieved by using PIN diodes to switch the diode circuits across the PIFA radiating branches, while fine tuning is achieved by using variable capacitance (varactor) diodes. For both D1 and for D2, PIN and varactor diode biasing circuitry 9 is disposed on the board's top layer. The four element reconfigurable antenna is fabricated on a single substrate of dimensions 10, 11, which may be approximately 65×120 $mm^2$, as shown. Antenna D2 provides an additional reconfigurability mode by a shorting wall 12 on the edge of the board connecting the top layer to the ground (GND) plane on the bottom surface. This "additional reconfigurabilty" is achieved using a PIN diode. FIGS. 2A and 2B show the bottom surface of the printed circuit board (PCB) for antenna system embodiments D1 and D2, respectively. Antenna D2 has an additional biasing circuitry in which a PIN diode bias circuit 9 is used for controlling current on the GND plane, resulting in additional frequency bands as compared to antenna D1. The various dimensions of GND plane of D1 and D2 are given as 13 (49.5 mm), 14 (25 mm), 15 (37.1 mm), 16 (11 mm), 17 (38 mm) 18 (42 mm), 19 (5.44 mm), 20 (1.48 mm), 21 (47 mm) 22 (51.1 mm), 23 (1.68 mm), 24. (37.1 mm), 25 (5.44 mm), 26 (4.1 mm) 27 (25 mm), 28 (11 mm), and 29 (17.8 mm) for a height of 1.56 mm and a relative permittivity ($\in_r$)=3.55.

Figure 3A:
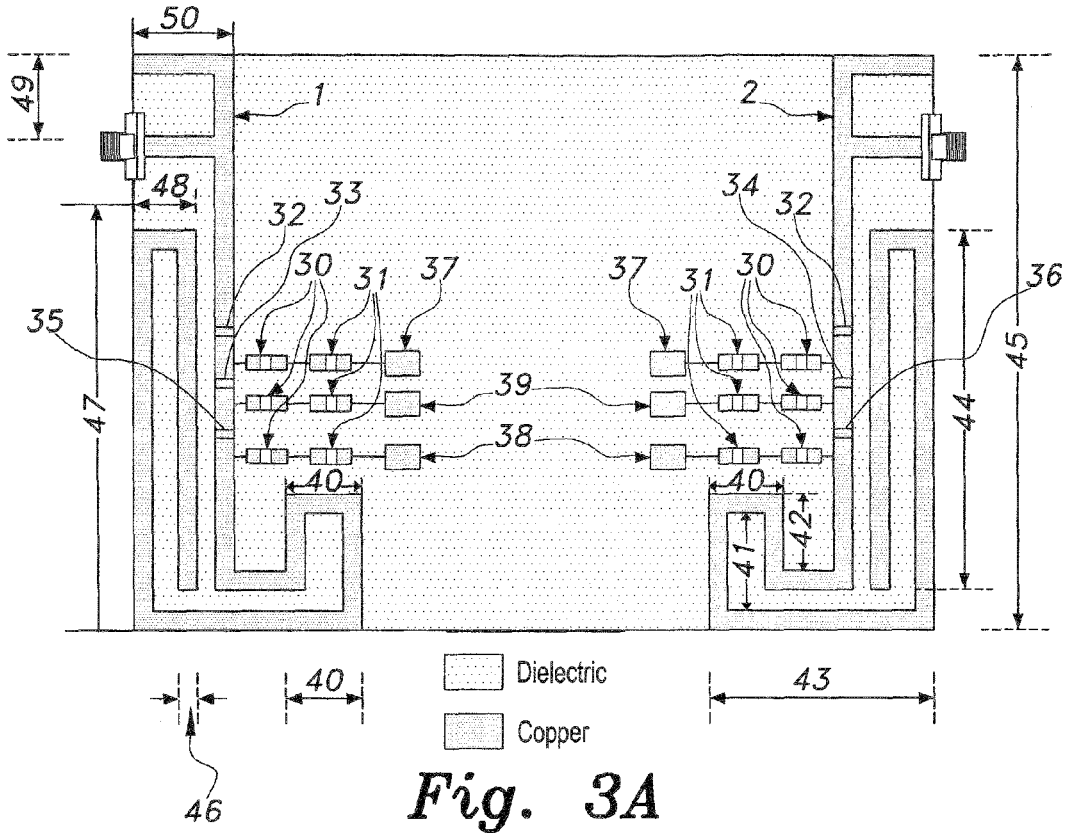
FIG. 3A is a partial top view of the printed circuit board of FIG. 1A, showing the configuration of two of the PIFA radiating elements in greater detail.

FIG. 3A shows a detailed view of two out of the four PIFA element antennas 1, 2, with associated bias circuitry 9. The corresponding PIFA elements 1, 2, 3, and 4 of D1 and D2 have identical configuration. PIN and varactor diode has similar biasing circuitry, including a 1 μH RF choke 30 in series with a 2.1 kΩ resistor 31. PIN diodes 33, 34 are used for switching purposes across the radiating branches for the four antennas 1, 2, 3, and 4, while varactor diodes 35 and 36 are used to vary the impedance of the two antennas. Vcc is +5V applied at pad 37, while pad 39 is provided as a digital reference GND. A fixed +5V is applied to the PIN diodes 33, 34 to switch them "on", while a variable voltage is applied at pad 38 to bias the varactor diode 35, 36 for introducing variable capacitance in the radiating slot of each reconfigurable PIFA antenna. All antenna elements of a single design (either D1 or D2) are exactly similar in structure. DC blocking capacitors 32 are connected across each branch as coupling capacitors. The dimensions of different radiating parts of top layers of PIFA are second meander bend 40 (5.78 mm), height 41 between second meander bend and a third meander bend (8.52 mm), height 42 between a first meander bend and second meander bend 40 (6.52 mm), distance 43 between edge adjacent meander line and meander line most distal from edge adjacent meander line (17.7 mm), Height 44 of terminal meander line (38.96 mm), dielectric substrate width 45 (56.6 mm), meander line width 46 (1.48 mm), half of gap distance 47 between SMA connecter and edge meander line (43.7 mm), distance 48 between edge meander line and terminal meander line (6.42 mm), distance 49 between centerline of SMA connector and top arm of F head portion of the PIFA (8.4 mm), Length 50 of top arm (7.9 mm), and distance 51 between dielectric peripheral edge and copper radiating edge is 7.9 mm.

Figure 3B:
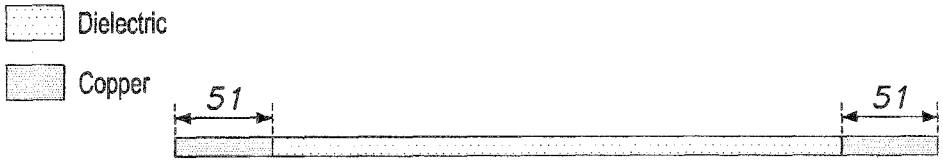
FIG. 3B is a side view of the printed circuit board of FIG. 1A, showing one of the short edges of the board.
Figure 3C:
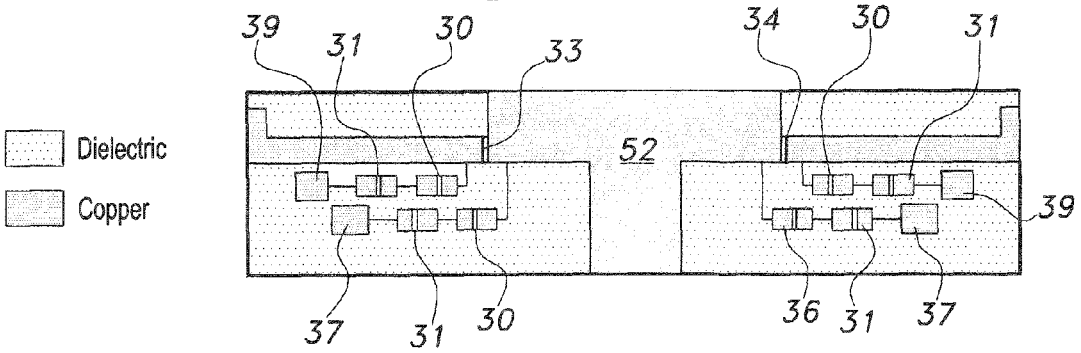
FIG. 3C is a detail view of the portion of the bottom of the board outlined in dashed lines in FIG. 2B, showing bias circuits for the ground plane elements in the second embodiment of a four element reconfigurable MIMO antenna system according to the present invention.
Figure 4:
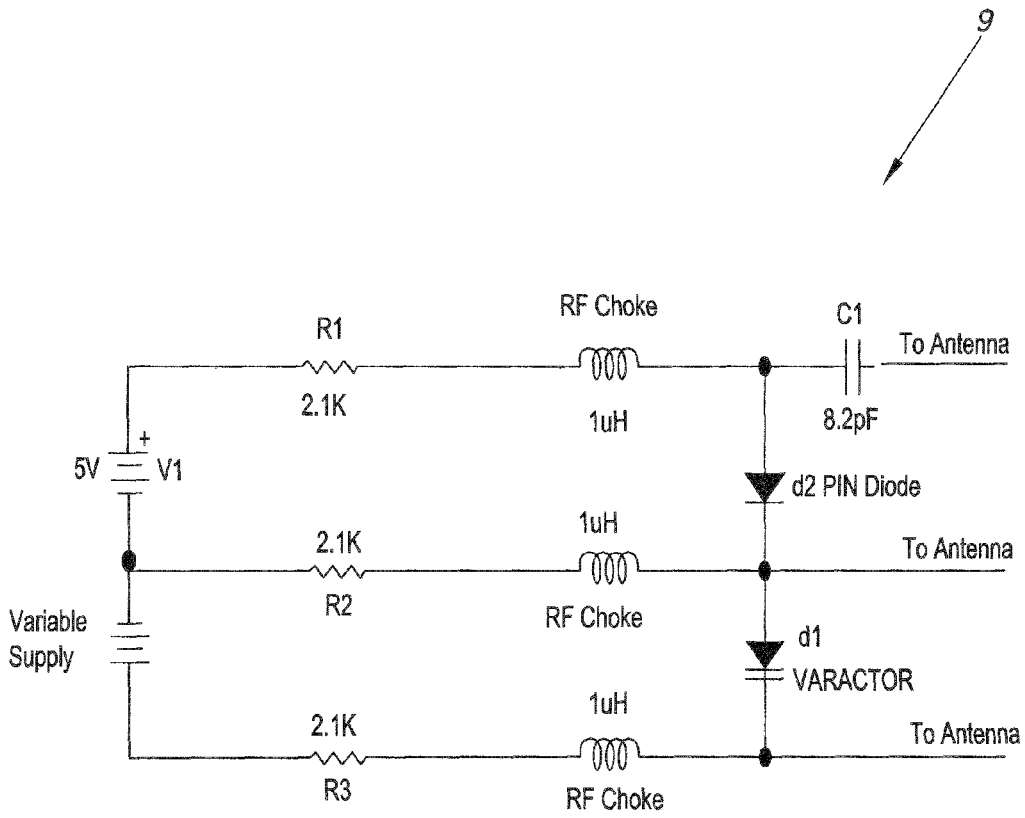
FIG. 4 is a schematic diagram of the bias circuits of the radiating elements of a four element reconfigurable MIMO antenna system according to the present invention.

FIG. 3B shows a side view of the printed circuit board, showing that the top arm of the PIFA radiating elements 1, 2 are shorted to ground along the short edge of the board. FIG. 3C shows a detailed view of a portion 52 of the bottom surface of the D2 antenna system embodiment, including the biasing circuitry of the PIN diode for controlling current on the GND plane. The same PIN diode biasing 9 (except that no varactor diodes are used on the bottom surface, so that no bias circuitry for varactor diodes is necessary; only PIN diode biasing is present on the bottom surface) is used in the portion 52 of the bottom surface that was used for the radiating elements of the PIFA antennas 1, 2, 3, and 4 on the top surface. The PIN diodes on the bottom surface connect laterally extending ground stubs to the central patch ground plane when a forward bias is applied to the diodes, changing the electrical length and resonant frequency of the UWB antenna. The complete detailed bias circuit 9 for PIN and varactor diodes for a single antenna element is shown in FIG. 4. As shown in FIG. 4, biasing (PIFA diode) circuit 9 comprises a first loop and a second loop. The first loop of the PIFA diode circuit 9 includes a first fixed resistance R1 in series with a first fixed radio frequency (RF) choke connected to an anode of the PIN diode d2. A second fixed resistance R2 is in series with a second fixed radio frequency (RF) choke which is connected to a cathode of PIN diode d2. A fixed DC voltage has its positive terminal connected to the first fixed resistance R1 and its negative terminal connected to the second fixed resistance R2, thereby closing the first loop. With respect to the second loop, the second fixed resistance R2, which is in series with the second fixed radio frequency (RF) choke, is connected to an anode of the varactor diode d1. A third fixed resistance R3 is in series with a third fixed radio frequency (RF) choke, which is connected to a cathode of the varactor diode d1. A variable DC voltage has its positive terminal connected to the third fixed resistance R3 and its negative terminal connected to the second fixed resistance R2, thereby closing the second loop.

The ON/OFF operation of the PIN diodes results in two modes (D1-Mode-1, D1-Mode-2) of operation for D1, while it results in three modes (D2-Mode-1, D2-Mode-2, D2-Mode-3) of operation for D2. All the modes for both designs are given as follows.

Figure 5:
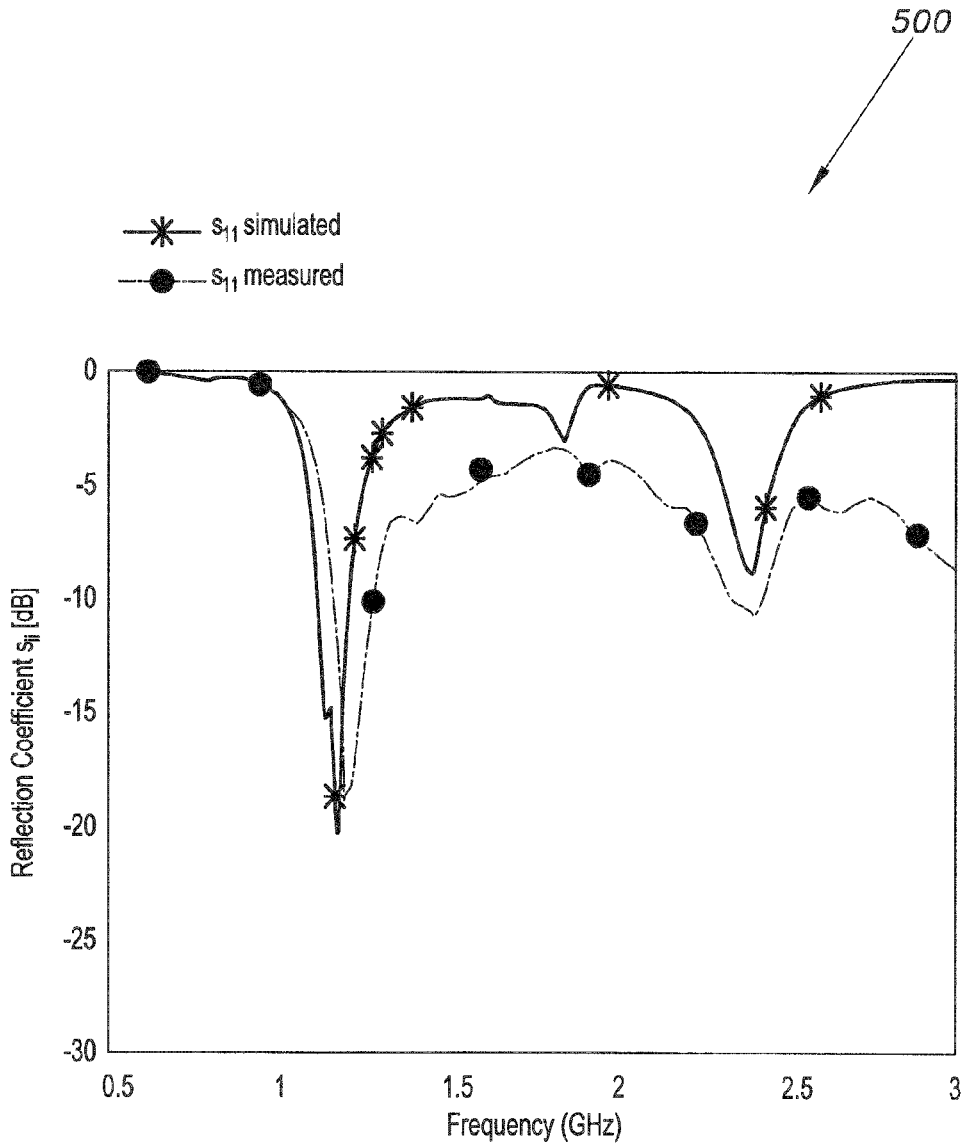
FIG. 5 is a plot showing simulated and measured reflection coefficients as a function of frequency for the first embodiment of a four element reconfigurable MIMO antenna system according to the present invention when operated in a mode with the PIN diodes "off" and the varactor diodes reverse biased.

In D1-mode-1, the PIN diodes are switched OFF, while the varactor diodes are reverse biased. The reverse bias voltage is varied between 0~6 Volts. For mode-1, the effect of capacitance variation on the radiating structure is minimal, and hence on the resonant frequency as well. The resulting simulated and measured reflection coefficients of mode-1 are shown in FIG. 5. In mode-1, the bands covered are 1170 MHz and 2420 MHz, with a −6 dB operating bandwidth of at-least 100 MHz in both bands.

Figure 6:
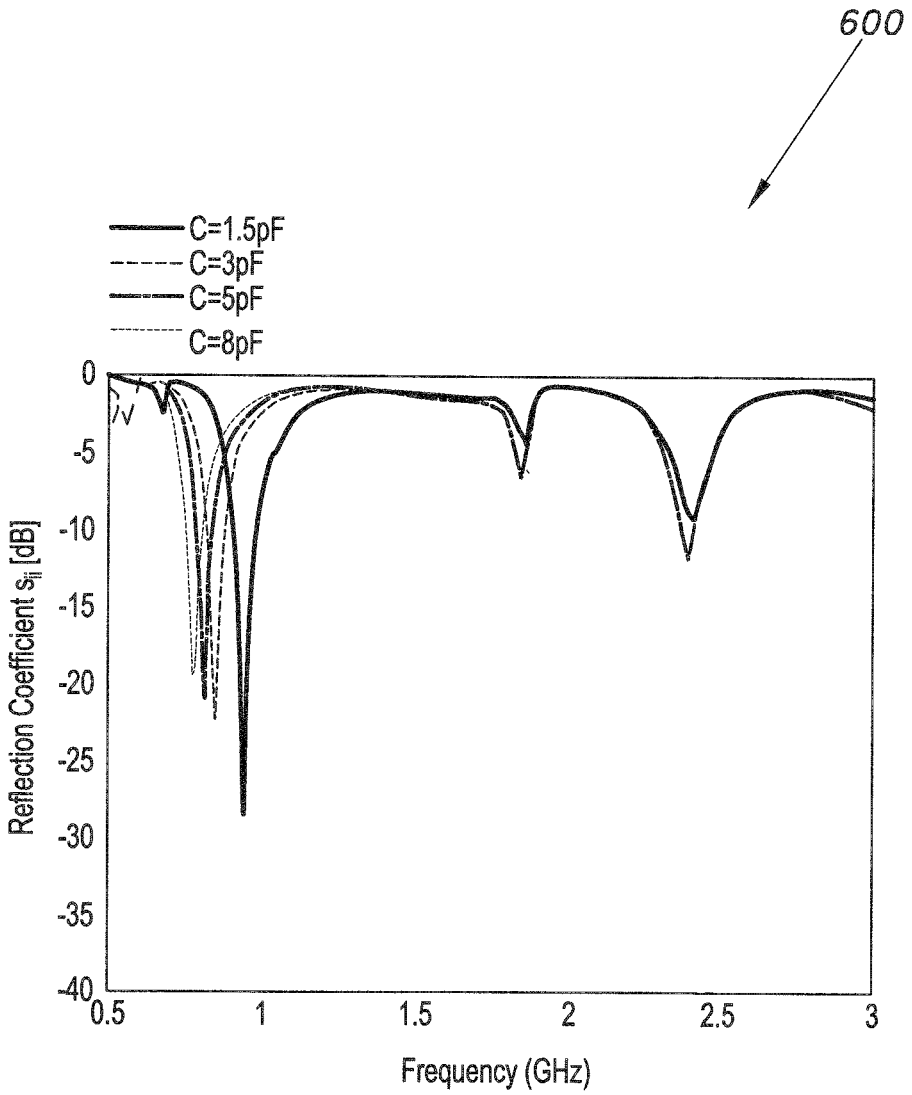
FIG. 6 is a plot showing simulated reflection coefficients as a function of frequency for the first embodiment of a four element reconfigurable MIMO antenna system according to the present invention when operated in a mode with the PIN diodes "on" and a reverse bias varied between 0-6 volts applied to the varactor diodes.
Figure 7:
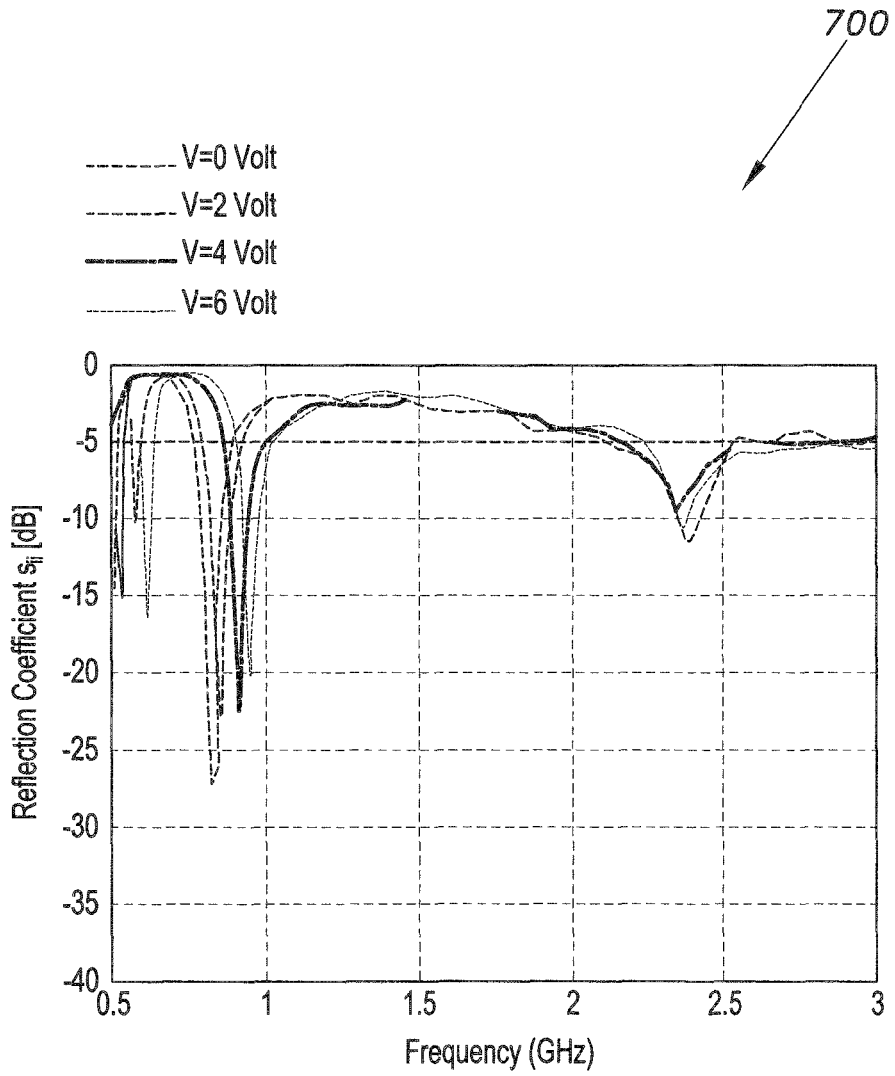
FIG. 7 is a plot showing measured reflection coefficients as a function of frequency for the first embodiment of a four element reconfigurable MIMO antenna system according to the present invention when operated in a mode with the PIN diodes "on" and a reverse bias varied between 0-6 volts applied to the varactor diodes.

In D1-mode-2 for D1, the PIN diodes are switched ON (by apply 5 volts to pad 37 and ground to pad 39) and varactor diodes reverse bias voltage (between pads 39 and 38) was varied between 0~6 volts. In this mode, varactor diodes have a significant effect on the resonant frequencies. The resonant frequency was smoothly changed at the lower frequency band below 1 GHz. A significant bandwidth is achieved at the lower bands, while the addition of a reactive impedance has insignificant effects on the higher frequency band. The first resonating frequency was varied between 743~1030 MHz, while the second band was relatively constant at 2400 MHz. The minimum −6 dB operating bandwidth for the two bands was 60 MHz and 120 MHz, respectively. The simulated reflection coefficients are shown in FIG. 6 for mode-2, while measured reflection coefficients are shown in FIG. 7.

Figure 8A:
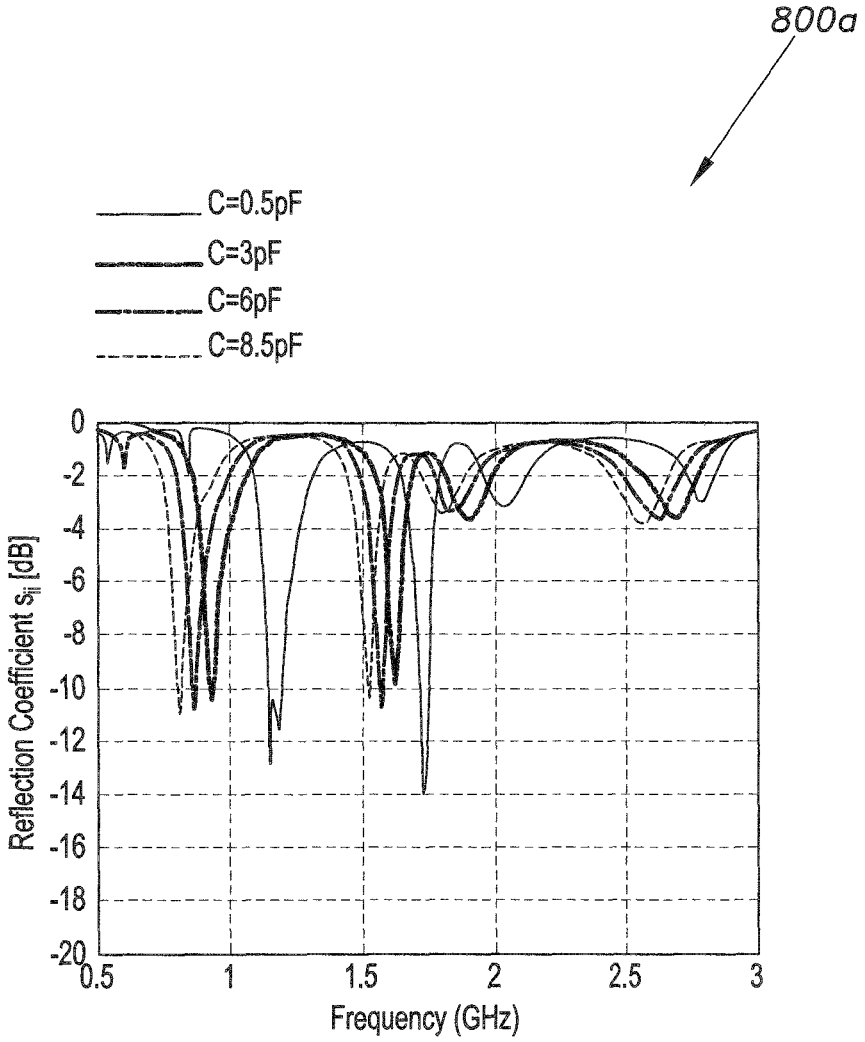
FIG. 8A is a plot showing simulated reflection coefficients as a function of frequency for the second embodiment of a four element reconfigurable MIMO antenna system according to the present invention when operated in a mode with the PIN diodes "off" on both the top and bottom faces of the printed circuit board and a reverse bias voltage varied between 0-6V applied to the varactor diodes.
Figure 8B:
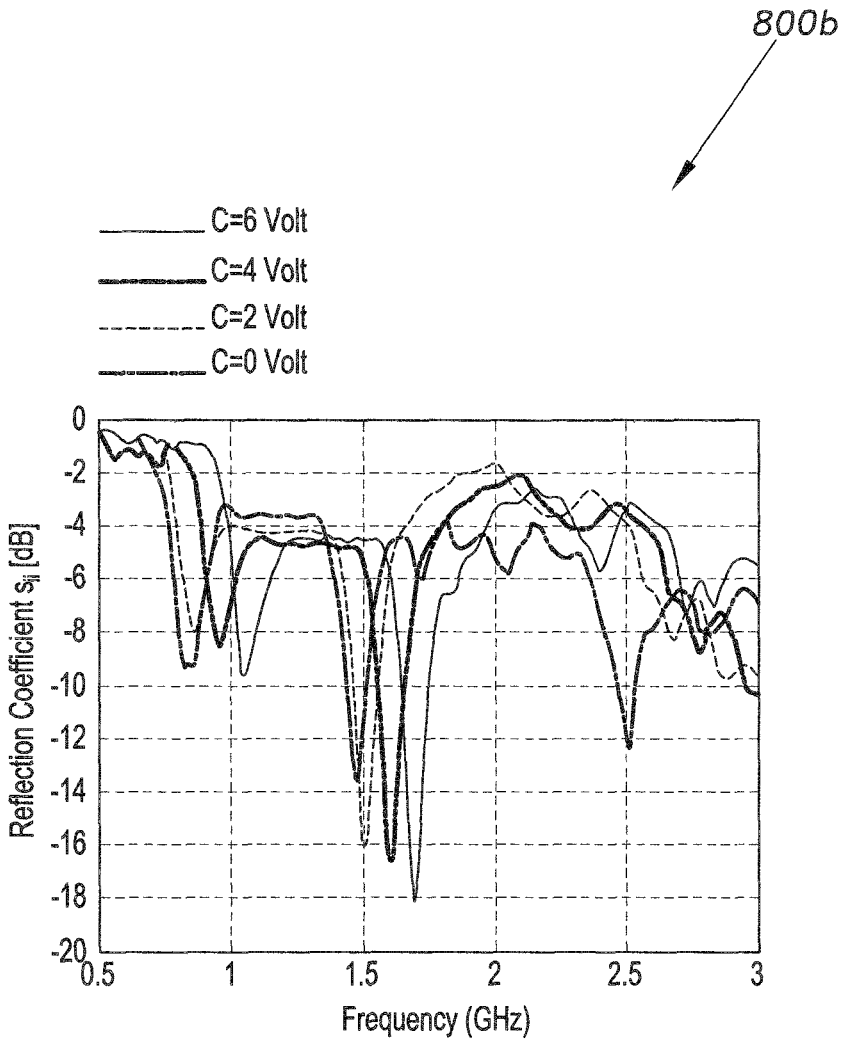
FIG. 8B is a plot showing measured reflection coefficients as a function of frequency for the second embodiment of a four element reconfigurable MIMO antenna system according to the present invention when operated in a mode with the PIN diodes "off" on both the top and bottom faces of the printed circuit board and a reverse bias voltage varied between 0-6V applied to the varactor diodes.

In D2-mode-1, all PIN diodes 33. 34 on top and bottom layers are switched OFF, while the capacitance of varactor diodes 35, 36 on the top layer is varied by applying a reverse bias voltage. The voltage across the varactor is varied between 0~6 Volts. The simulated and measured reflection coefficients of mode-1 are shown in FIGS. 8A and 8B, respectively. In mode-1, basically two resonances are achieved with a sweep of frequency bands using varactor diodes. The operating bands are 780~1230 MHz and 1490~1760 MHz. The −6 dB operating bandwidth in both bands is at-least 60 MHz and 50 MHz, respectively.

Figure 8C:
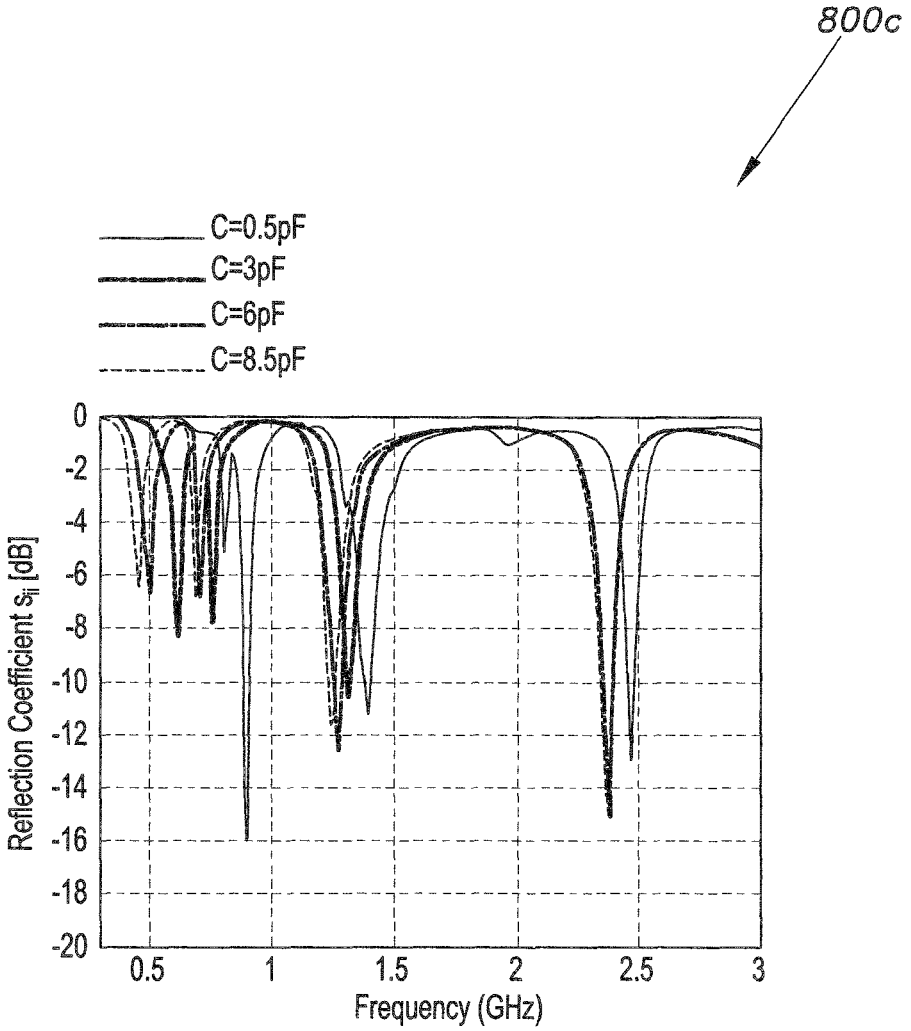
FIG. 8C is a plot showing simulated reflection coefficients as a function of frequency for the second embodiment of a four element reconfigurable MIMO antenna system according to the present invention when operated in a mode with the PIN diodes "on' on the top face and "off"on the bottom face of the printed circuit board and a reverse bias voltage varied between 0-6V applied to the varactor diodes.
Figure 8D:
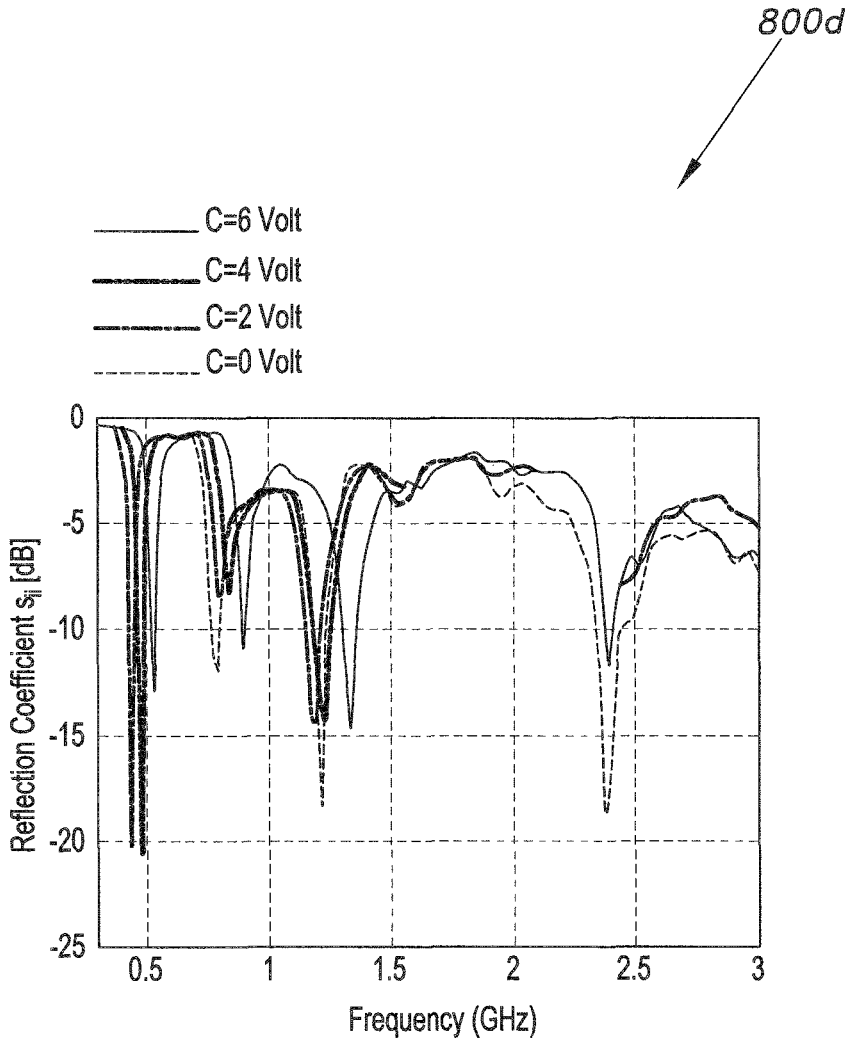
FIG. 8D is a plot showing measured reflection coefficients as a function of frequency for the second embodiment of a four element reconfigurable MIMO antenna system according to the present invention when operated in a mode with the PIN diodes "on' on the top face and "off" on the bottom face of the printed circuit board and a reverse bias voltage varied between 0-6V applied to the varactor diodes.

In D2-mode-2, the PIN diodes on the top surface of the antenna are activated (turned on by applying 5 volts between pads 37 and 39), while the PIN diodes embedded on the reference plane are switched OFF (by connecting pads 37 and 39 to ground). The reverse bias voltage across varactor diodes 35, 36 on the top layer was varied between 0~6 volts. In this mode, there are four resonance frequency bands. Smooth variation of the operating frequencies were observed for the lower two bands, while the addition of reactive impedance has insignificant effects on higher frequency band at 2.4 GHz. The first two resonating frequencies were actually overlapping each other when varying the capacitance of varactor diodes 35, 36. The frequency sweep observed for the first two bands was from 610~920 MHz, with minimum −6 dB bandwidth of 30 MHz. The third resonating band varied from 1210~1430 MHz, with −6 dB operating bandwidth of 90 MHz. The fourth frequency band is relatively independent of varactor capacitance and was constant at 2.4 GHz, with −6 dB operating bandwidth of 100 MHz. The simulated and measured reflection coefficient curves for mode-2 are shown in FIGS. 8C and 8D, respectively.

Figure 8E:
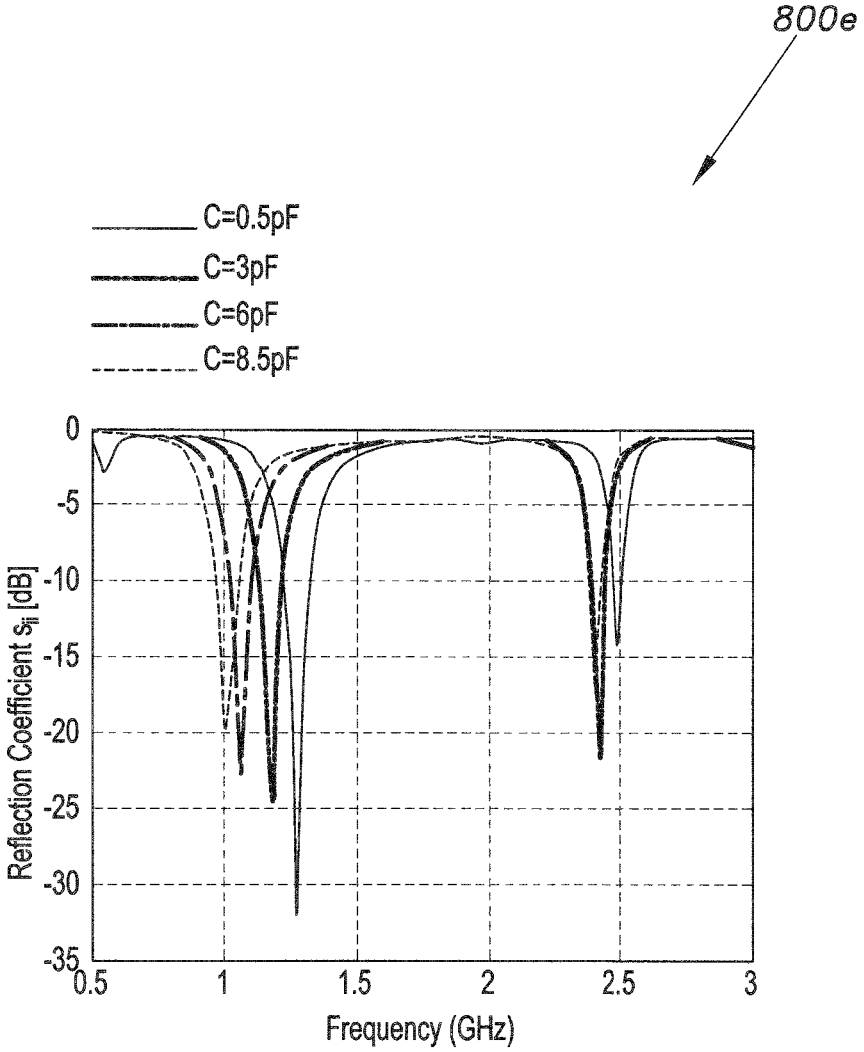
FIG. 8E is a plot showing simulated reflection coefficients as a function of frequency for the second embodiment of a four element reconfigurable MIMO antenna system according to the present invention when operated in a mode with the PIN diodes "on' on both the top and bottom faces of the printed circuit board and a reverse bias voltage varied between 0-6V applied to the varactor diodes.
Figure 8F:
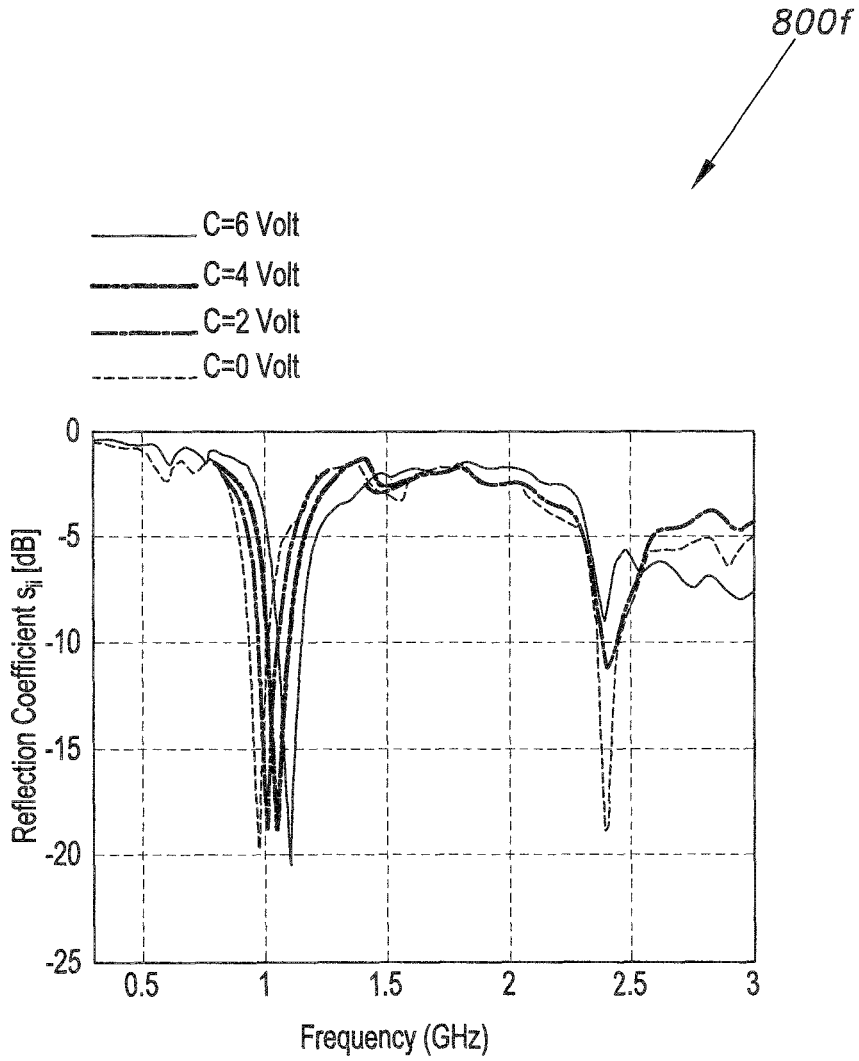
FIG. 8F is a plot showing measured reflection coefficients as a function of frequency for the second embodiment of a four element reconfigurable MIMO antenna system according to the present invention when operated in a mode with the PIN diodes "on' on both the top and bottom faces of the printed circuit board and a reverse bias voltage varied between 0-6V applied to the varactor diodes.

In D2-mode-3, all the PIN diodes 33, 34 on the top and bottom of the circuit board were switched ON, and reverse bias voltage was applied across the varactor diodes on the top of the circuit board. In mode-3, two resonating bands were achieved. Smooth variation of the operating frequencies was observed for the lower band, while the addition of reactive impedance has insignificant effects on higher frequency bands. The first resonating frequency varied between 940~1350 MHz, while the second band was relatively constant at 2400 MHz. The minimum −6 dB operating bandwidth for the two bands was 140 MHz and 90 MHz, respectively. The simulated reflection coefficient curves are shown in FIG. 8E, while the measured reflection coefficient curves for mode-3 are shown in FIG. 8F.

The 3D gain patterns of the present reconfigurable MIMO antenna system were computed using HFSS™. The gain patterns for four antenna elements for D1-mode-1 and D2-mode-2 at 1160 MHz and 1040 MHz were computed, revealing that gain pattern tilting capability of the present antenna system can provide enhanced MIMO features due to low correlation coefficient of the present system.

It is to be understood that the present invention is not limited to the embodiments described above, but encompasses any and all embodiments within the scope of the following claims.

We claim:

1. A four element reconfigurable MIMO antenna system, comprising:

a rectangular dielectric substrate having a top surface, a bottom surface, opposing short peripheral edges, and opposing long peripheral edges;

first, second, third, and fourth PIFA radiating elements disposed on the top surface of the rectangular dielectric substrate, each of the PIFA radiating elements having an F-head portion of the PIFA defining two arms extending to one of the long peripheral edges of the rectangular dielectric substrate and an F-tail portion extending from one of the short peripheral edges of the rectangular dielectric substrate and having a meander pattern of conducting material extending from a bottom region of the F-tail portion, the first PIFA and second PIFA radiating elements being mirror images of each other, and the third PIFA and fourth PIFA radiating elements being mirror images of each other;

a corresponding bias circuit disposed in each of the four PIFA radiating elements between the two arms of the F-head portion and the meander pattern at the bottom region of the F-tail portion, the bias circuit including:

a PIN diode and a varactor diode connected in series in the F-tail portion;

a ground reference terminal extending from the F-tail portion between the PIN diode and the varactor diode;

a positive voltage terminal extending from the F-tail portion above the PIN diode; and a variable voltage terminal extending from the F-tail portion below the varactor diode; whereby the PIN diode may be switched ON and OFF to lengthen or shorten electrical length of the F-tail portion and a variable voltage may be applied across the varactor diode to change electrical impedance of the F-tail portion;

a feed connector connected to the F-head portion arm most distal from the short peripheral edge of the rectangular dielectric substrate of each of the PIFA radiating elements; and a ground plane for each of the PIFA radiating elements disposed on the bottom surface of the rectangular dielectric substrate.

2. The four element reconfigurable MIMO antenna system according to claim 1, wherein each of the bias circuits has a first loop having:

a first fixed resistance and a first fixed radio frequency (RF) choke connected in series with the first fixed resistance, the choke being connected to an anode of the PIN diode and the first fixed resistance being connected to the positive voltage terminal; and a second fixed resistance and a second fixed radio frequency (RF) choke connected in series with the second fixed resistance, the choke being connected to a cathode of the PIN diode and to an anode of the varactor diode, and the second fixed resistance being connected to the ground reference terminal; and wherein the PIN diode is switched ON by connecting a fixed DC voltage to the positive voltage terminal and switched OFF by disconnecting the fixed DC voltage from the positive voltage terminal.

3. The four element reconfigurable MIMO antenna system according to claim 2, wherein each of the bias circuits has a second loop having a third fixed resistance and a third fixed radio frequency (RF) choke connected in series with the third fixed resistance, the third fixed radio frequency (RF) choke being connected to a cathode of the varactor diode and the third fixed resistance being connected to the variable voltage terminal, wherein the varactor diode has variable capacitance by connecting a variable DC voltage to the variable voltage terminal.

4. The four element reconfigurable MIMO antenna system according to claim 3, further comprising DC blocking capacitors in each of the bias circuits connected as coupling capacitors between the PIN diode and the two arms of the F-head portion.

5. A method of configuring the four element reconfigurable MIMO antenna system according to claim 4 in a first mode, comprising the step of switching the PIN diodes in the first, second, third, and fourth PIFA radiating elements OFF, whereby the system is resonant at 1170 MHz and at 2420 MHz, the system having a −6 dB operating bandwidth of at least 100 MHz in both bands.

6. A method of configuring the four element reconfigurable MIMO antenna system according to claim 4 in a second mode, comprising the steps of switching the PIN diodes in the first, second, third, and fourth PIFA radiating elements ON and applying a voltage between 0V and 6V DC to the variable voltage terminal, whereby the system is resonant between 743~1030 MHz with a minimum −6 dB operating bandwidth of 60 MHz, and resonant at 2400 MHz with a minimum −6 dB operating bandwidth of 120 MHz.

7. The four element reconfigurable MIMO antenna system according to claim 4, further comprising a corresponding PIN diode ground plane biasing circuit connected to each of the ground planes disposed on the bottom surface of the rectangular dielectric substrate to control ground plane currents for the corresponding PIFA radiating elements.

8. The four element reconfigurable MIMO antenna system according to claim 7, further comprising a shorting wall connecting each of the four PIFA radiating elements to the corresponding ground plane.

9. The four element reconfigurable MIMO antenna system according to claim 7, wherein each said ground plane for each of the PIFA radiating elements comprises a central patch and a ground stub extending lateral to the central patch, said ground plane biasing circuit comprising:

a PIN diode connected between the central patch and the ground stub, the PIN diode having an anode and a cathode;

a negative voltage terminal pad;

a first resistor and a first RF choke connected in series between the negative voltage terminal pad and the cathode of the PIN diode;

a positive voltage terminal pad; and a second resistor and a second RF choke connected in series between the positive voltage terminal pad and the anode of the PIN diode.

10. A method of configuring the four element reconfigurable MIMO antenna system according to claim 9 in a first mode, comprising the steps of switching the PIN diodes in the first, second, third, and fourth PIFA radiating elements and in the ground planes OFF, and applying a voltage between 0V and 6V DC to the variable voltage terminals, whereby the system is resonant at 780~1230 MHz with a −6 dB operating bandwidth of at least 60 MHz, and at 1490~1760 MHz with a −6 dB operating bandwidth of at least 50 MHz.

11. A method of configuring the four element reconfigurable MIMO antenna system according to claim 9 in a second mode, comprising the steps of switching the PIN diodes in the first, second, third, and fourth PIFA radiating elements ON and switching the PIN diodes in the ground planes OFF, and applying a voltage between 0V and 6V DC to the variable voltage terminals, whereby the system is resonant at two overlapping bands at 610~920 MHz with minimum −6 dB bandwidth of 30 MHz, at 1210~1430 MHz with −6 dB operating bandwidth of 90 MHz, and at 2.4 GHz with −6 dB operating bandwidth of 100 MHz.

12. A method of configuring the four element reconfigurable MIMO antenna system according to claim 9 in a third mode, comprising the steps of switching the PIN diodes in the first, second, third, and fourth PIFA radiating elements ON, switching the PIN diodes in the ground planes ON, and applying a voltage between 0V and 6V DC to the variable voltage terminals, whereby the system is resonant at 940~1350 MHz with minimum −6 dB bandwidth of 140 MHz, and at 2.4 GHz with −6 dB operating bandwidth of 90 MHz.

* * * * *